US006116753A

United States Patent [19]

Tsang

[11] Patent Number: 6,116,753

[45] Date of Patent: Sep. 12, 2000

[54] ILLUMINATED SOAP BAR

[75] Inventor: Henry H. T. Tsang, Richmond Hill, Canada

[73] Assignee: Eastgate Innovations Incorporated, Mississauga, Canada

[21] Appl. No.: 09/201,853

[22] Filed: Dec. 1, 1998

[51] Int. Cl.[7] ..... F21V 33/00

[52] U.S. Cl. ..... 362/253; 362/101; 362/157; 362/158; 362/189; 362/276; 362/800; 362/802; 362/311

[58] Field of Search ..... 362/101, 157, 362/158, 189, 276, 800, 802, 311, 253

[56] References Cited

U.S. PATENT DOCUMENTS 5,175,951 1/1993 Fruchey ..... 43/17.6
5,211,469 5/1993 Matthias et al. ..... 362/101
5,330,282 7/1994 Rodgers ..... 43/17.6
5,545,069 8/1996 Glynn et al. ..... 362/253

*Primary Examiner*—Sandra O'Shea
*Assistant Examiner*—Ronald E. DelGizzi
*Attorney, Agent, or Firm*—Ingrid E. Schmidt

[57] ABSTRACT

An illuminated soap bar including a soap body and an electronic circuit incorporated into the soap body. The circuit has the following: a pair of spaced-apart probes electrically exposed for contact with a conductive medium; at least one light source for emitting light visible externally of the body; and a power supply for supplying electrical current to the light source. The electronic circuit is designed to allow electrical current to flow to and illuminate the light source when the probes are in contact with a conductive medium which defines a conductive path between the probes.

7 Claims, 3 Drawing Sheets

ILLUMINATED SOAP BAR

FIELD OF THE INVENTION

The present invention relates to toy bath accessories and, more particularly, to novelty soap bars.

BACKGROUND OF THE INVENTION

Novelty soap bars traditionally come in a wide range of colors, shapes, and sizes selected to add fun to one's bathing and/or showering experience. An example is a soap bar shaped as a hand microphone and mounted on a looped rope to be worn around a person's neck. When in the shower, the person may pretend to be a singing star, singing into the soap microphone.

While this and other novelty soap bars have proven commercially successful in the past, an object of the invention is to provide a new and improved novelty soap bar that is fun to handle.

SUMMARY OF THE INVENTION

In accordance with the invention, there is provided an illuminated soap bar including a soap body and an electronic circuit incorporated into the soap body. The circuit has the following: a pair of spaced-apart probes electrically exposed for contact with a conductive medium; at least one light source for emitting light visible externally of the body; and a power supply for supplying electrical current to the light source. The electronic circuit is adapted to allow electrical current to flow to and illuminate the light source when the probes are in contact with a conductive medium which defines a conductive path between the probes.

BRIEF DESCRIPTION OF THE DRAWINGS

Preferred embodiments of the invention will now be described with reference to the drawings in which.

DETAILED DESCRIPTION OF THE PREFERRED EMBODIMENT

Figure 1:
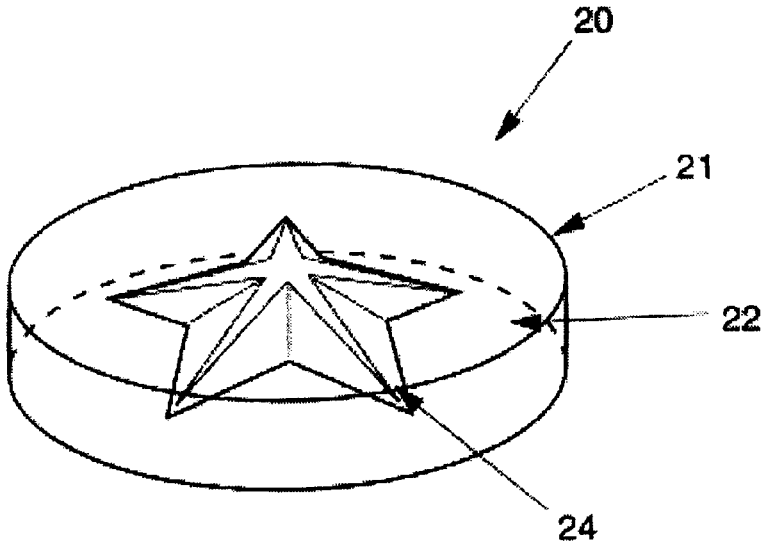
FIG. 1 is a schematic perspective view of a soap bar according to a first preferred embodiment of the invention.

An illuminated soap bar, designated generally by reference numeral 20, is shown in FIG. 1. The soap bar 20 has a translucent soap body referred to generally by numeral 21 including a translucent light blue cylindrical first soap body portion 22 and a translucent yellow star-shaped second soap body portion 24 contained within the first soap body portion 22 to be illuminated as follows.

Figure 2:
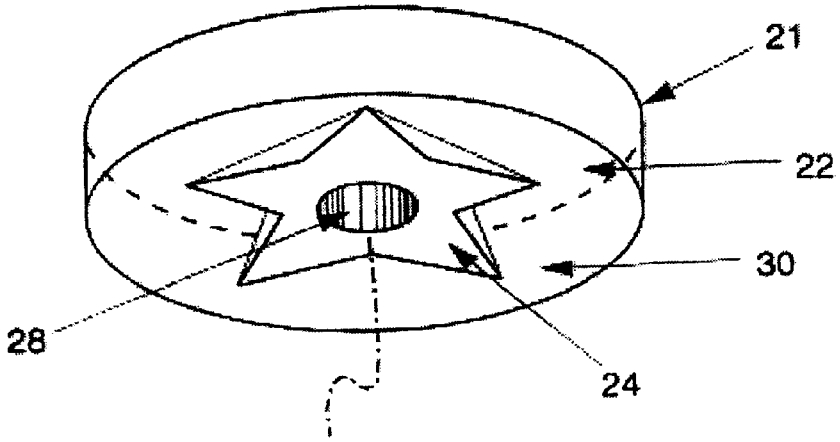
FIG. 2 is a schematic assembly drawing of the soap bar of FIG. 1 showing a waterproof housing included in the soap bar, which housing contains a light emitting diode, a printed circuit board, and batteries.
Figure 3:
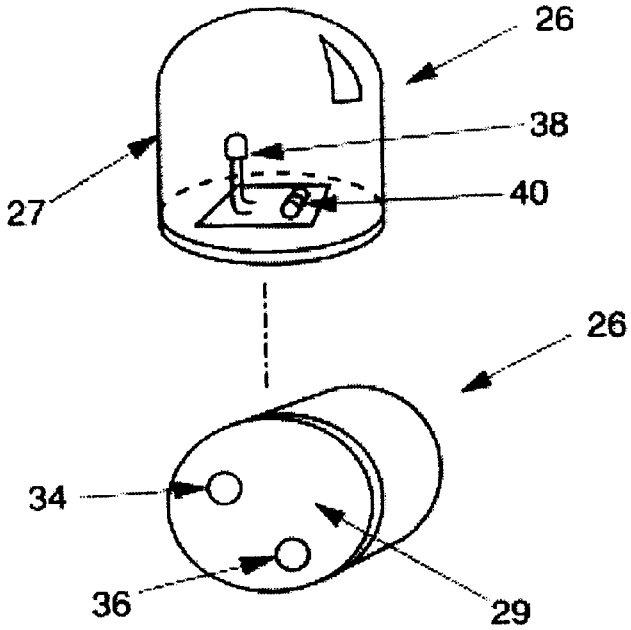
FIG. 3 is a schematic perspective view of the waterproof housing of FIG. 2 showing a pair of probes exposed through a bottom of the housing.
Figure 4:
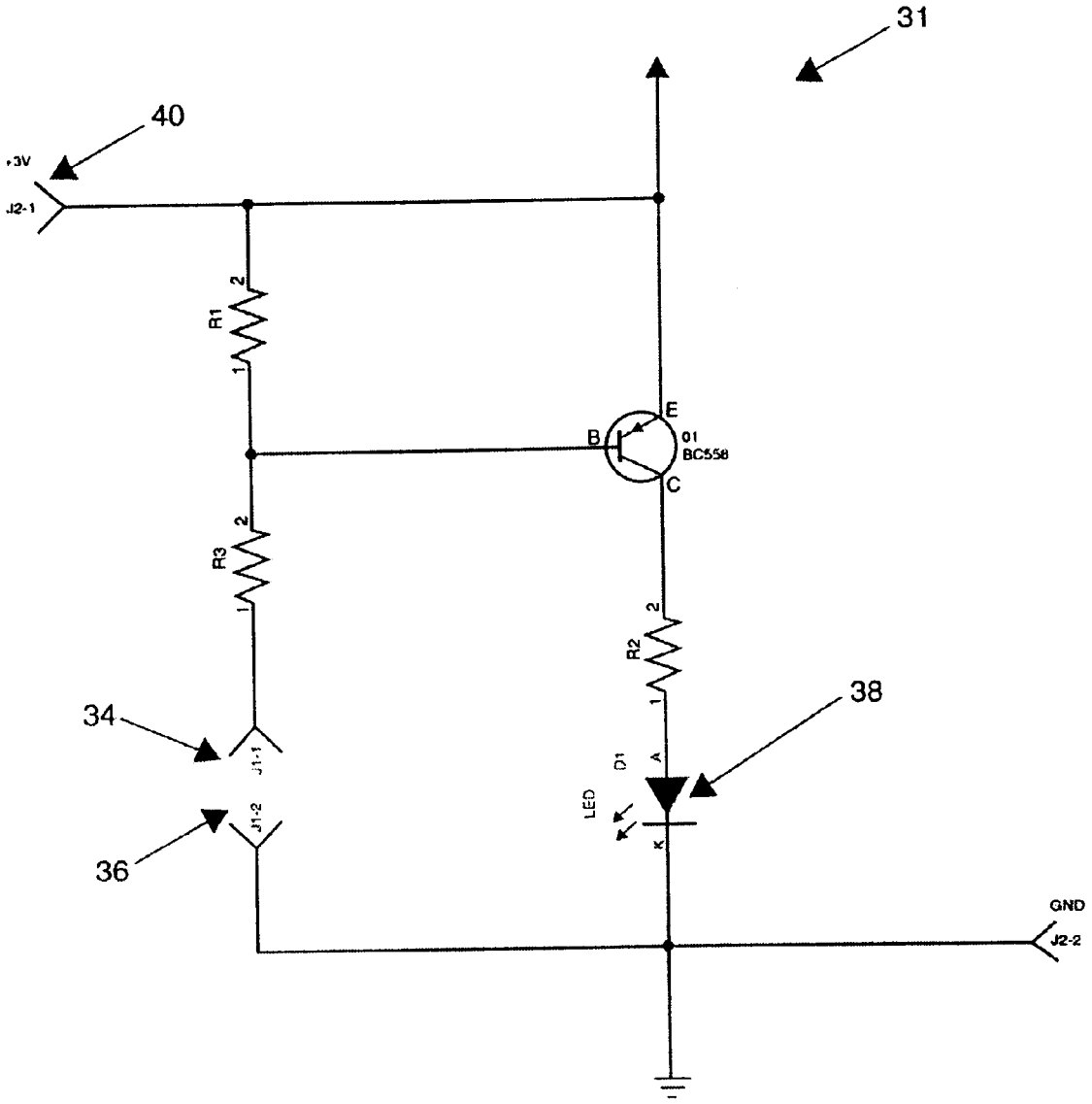
FIG. 4 is a schematic circuit diagram showing the battery and related components of the electronic circuitry of the printed circuit board of FIG. 2 for energizing the light emitting diode.

Referring mainly to FIG. 2, but with reference also to FIGS. 3 and 4, a waterproof light transmittable housing 26 having a transparent dome 27 is mounted within a cavity 28 of the second soap body portion 24. A portion of the housing 26 in the form of a bottom 29 (see FIG. 3) is exposed to the exterior of the soap body 21 and lies flush with a bottom 30 of the soap body 21.

The housing 26 contains an electronic circuit indicated generally at 31 (see FIG. 4) incorporated into a printed circuit board 32. The circuit 31 has a pair of spaced-apart probes in the form of electrodes 34, 36 being electrically exposed at the housing bottom 29 for contact with a conductive medium (see FIG. 3). The circuit 31 further includes at least one light source in the form of a single light emitting diode 38 positioned so as to illuminate the translucent second soap body portion 24 which light is visible externally of the soap body 21.

A power source in the form of batteries 40 supplies electrical current to the light emitting diode 38.

The electronic circuit 31 is designed to allow electric current to flow to and illuminate the light emitting diode 38 when the electrodes 34, 36 are in contact with a conductive medium which defines a conductive path between the electrodes 34, 36.

A schematic illustration of the electronic circuit 31 is shown in FIG. 4. When the electrodes 34, 36 come in contact with a conductive medium, such as water for example, a conductive path is defined between the electrodes 34, 36 and the electronic circuit 31 becomes a closed circuit. When closed, current may flow from the batteries 40 to the light emitting diode 38, thereby illuminating the light emitting diode 38. Upon removing the soap bar 20 from water, the electronic circuit 31 becomes an open circuit and current ceases to flow to the light emitting diode 38 which is then no longer illuminated.

Instead of water, one's hand could be used as the conductive medium. Placing one's hand against the electrodes 34, 36 will result in current flowing from the electrode 34 through the hand and to the electrode 36, and the light emitting diode thereby being illuminated. Clearly, the invention is not to be limited to or by the conductive media specifically disclosed herein.

Figure 5:
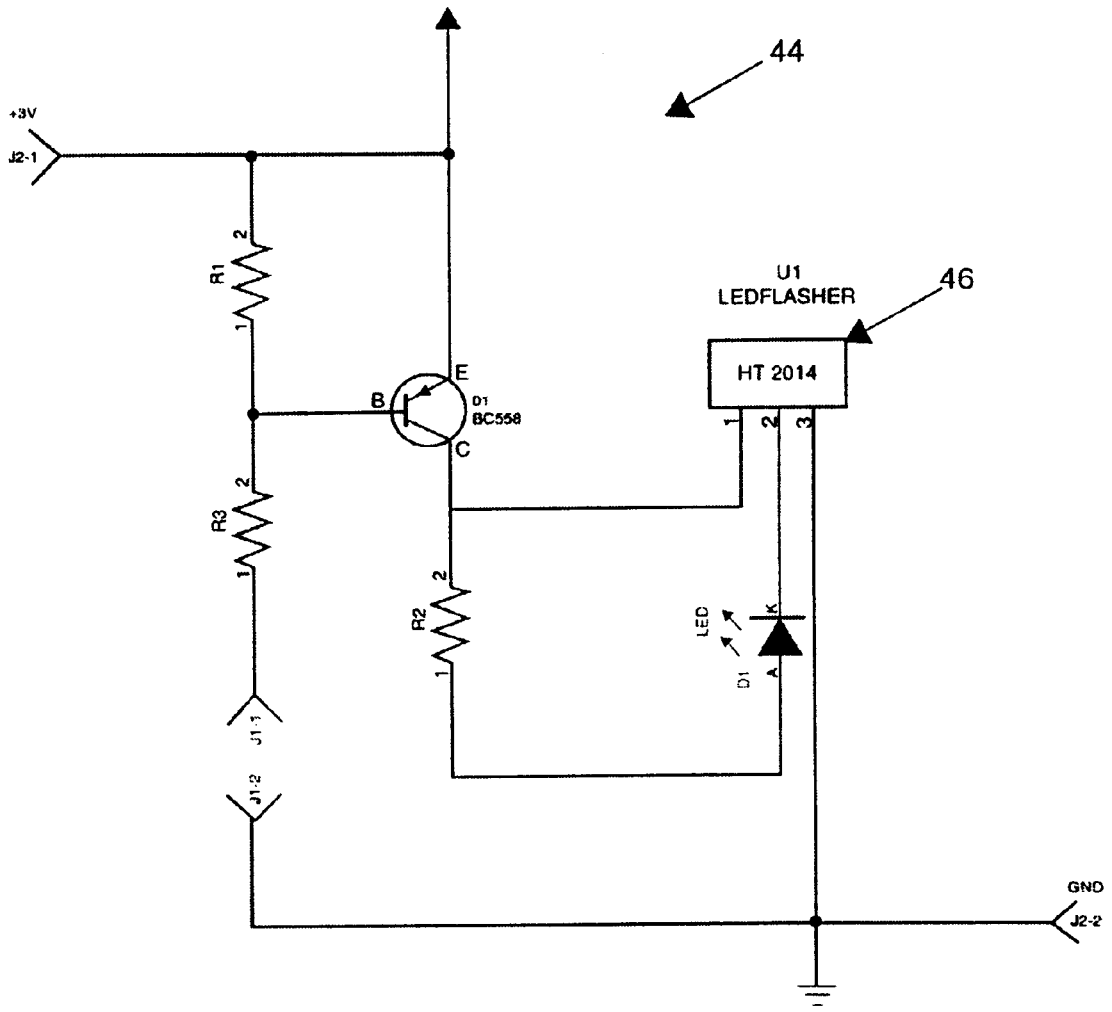
FIG. 5 is a schematic circuit diagram of an electronic circuit which may be used as an alternative to the electronic circuit shown in FIG. 4 in a soap bar according to a second preferred embodiment of the invention.

An electronic circuit designated generally by reference numeral 44 and shown schematically in FIG. 5 may be used as an alternative to the circuit 31 in the soap bar 20. The circuit 44 includes what is known as an "LED flasher" 46 which is readily available on the market and which itself includes electronic circuitry designed to respond to a flow of electric current therethrough to cause current to flow intermittently through a light-emitting diode 47 such that the light emitting diode 47 is illuminated intermittently and at regular intervals.

Similar to the circuit 31 of the first preferred embodiment, current may flow through the LED flasher 46 and light-emitting diode 47 when a conductive path is established between the electrodes 49, 51 to close the circuit 44. Again, the conductive path may be established by exposing the electrodes 49, 51 to a conductive medium such as water or a person's hand.

The LED flasher 46 is manufactured by, among others, a company named Holtek Microelectronics Inc. whose business address is No. 5 Creation Road, II, Science-based Industrial Park, Hsinchu, Taiwan, R.O.C.

Other alternatives to the first preferred embodiment described above are as follows. A soap bar according to the invention may incorporate known circuitry designed to illuminate the light emitting diode in accordance with a predetermined pattern when the electrodes are in contact with a conductive medium.

Further, the soap bar may have a soap body of any shape, size or color. The soap body may also be a combination of soap body portions of different shapes, sizes, and colors. The soap body may be clear or transparent rather than translucent. The soap body may also be opaque, in which case the light emitting diode may be mounted externally of the soap body.

The housing likewise may be of any size, shape or color. Where the light emitting diode is mounted within the housing, the housing or a portion thereof must be transparent or translucent. However, the housing may be opaque where the light source is mounted on a surface of the housing and, as such, is visible externally of the housing.

The light source may be any low voltage light bulb instead of a light emitting diode.

Clearly, the foregoing description is by way of example only and is not meant to limit the scope of the appended claims.

I claim:

1. An illuminated soap bar including a soap body and an electronic circuit incorporated into said body, said circuit having a pair of spaced-apart probes electrically exposed for contact with a conductive medium;

at least one light source for emitting light visible externally of said body; and a power source for supplying electrical current to said light source;

wherein said electronic circuit is designed to allow electrical current to flow to and illuminate said light source when said probes are in contact with a conductive medium which defines a conductive path between the probes.

2. An illuminated soap bar according to claim 1 wherein said soap body is translucent and said light source is mounted within said body.

3. A soap bar according to claim 2 wherein said body has a cavity, said soap bar further including a waterproof light-transmittable housing received by said cavity with a portion of said housing exposed to the exterior of said body, said electronic circuit being contained within said housing with said probes being electrically exposed at said portion for contact with a conductive medium.

4. A soap bar according to claim 3 wherein said light source is a light emitting diode.

5. A soap bar according to claim 4 wherein said power source is a battery.

6. A soap bar according to claim 5 wherein said soap body includes a first soap body portion; and a second soap body portion contained within said first soap body portion; and wherein said light emitting diode is positioned so as to illuminate said second soap body portion.

7. A soap bar according to claim 1 wherein said electronic circuit is adapted to cause intermittent illumination of said light source in accordance with a predetermined pattern when said probes are in contact with a conductive medium.

* * * * *